United States Patent [19]

Budziak et al.

[11] Patent Number: 4,586,150

[45] Date of Patent: Apr. 29, 1986

[54] ELECTRONIC MEASURING DEVICE

[75] Inventors: Frank W. Budziak, Cleveland; James O. Burton, Cleveland Heights; Frank J. Ahlin, Willoughby Hills, all of Ohio

[73] Assignee: Richman Brothers Company, Cleveland, Ohio

[21] Appl. No.: 532,245

[22] Filed: Sep. 14, 1983

[51] Int. Cl.[4] ..... G01B 7/18; G01B 7/30; G01D 5/16; H04L 23/00

[52] U.S. Cl. ..... 364/562; 33/1 PT; 33/143 M; 33/147 N; 33/366; 364/559

[58] Field of Search ..... 364/559, 561, 562; 33/1 PT, 1 N, 143 L, 143 M, 143 J, 143 K, 147 N, 147 L, 366

[56] References Cited

U.S. PATENT DOCUMENTS

| | | | |
|---|---|---|---|
| 2,772,411 | 11/1956 | Cooper | 33/366 X |
| 3,500,547 | 3/1970 | Van Haagen | 33/143 L |
| 3,895,356 | 7/1975 | Kraus | 364/562 X |
| 4,053,985 | 10/1977 | Spentzas | 33/1 N |
| 4,205,449 | 6/1980 | Waszmer | 33/147 N |
| 4,216,584 | 8/1980 | Meissner et al. | 33/143 L |
| 4,250,554 | 2/1981 | Blum et al. | 364/562 X |
| 4,257,107 | 3/1981 | Heymsfield et al. | 364/562 X |
| 4,295,278 | 10/1981 | Gloor | 33/143 L X |
| 4,435,904 | 3/1984 | Logan et al. | 33/143 L X |

FOREIGN PATENT DOCUMENTS

| | | | |
|---|---|---|---|
| 3142468 | 6/1982 | Fed. Rep. of Germany | 364/556 |
| 2025053 | 1/1980 | United Kingdom | 33/147 N |
| 2023838 | 3/1980 | United Kingdom | 33/143 L |

*Primary Examiner*—Felix D. Gruber

*Attorney, Agent, or Firm*—Watts, Hoffmann, Fisher & Heinke Co.

[57] ABSTRACT

A hand held device for taking measurements. The disclosed invention has particular utility for use in taking measurements for tailoring an article of clothing such as a suit. Two embodiments of the device are disclosed. One takes only length measurements and a second takes both length and angle measurements. Each includes a frequency modulated transmitter for sending signals corresponding to the measurements to a separate receiver and storage unit where the measurements are stored for later use in the tailoring process. In a preferred embodiment of the invention, the storage unit comprises a personal computer with a visual display that can prompt a user into taking the measurements in a predetermined sequence.

16 Claims, 13 Drawing Figures

ELECTRONIC MEASURING DEVICE

DESCRIPTION

1. Technical Field

The present invention concerns a measuring device and more particularly relates to a hand held unit for taking measurements to aid in custom tailoring an article of clothing such as a suit.

2. Background Art

The steps taken in tailoring a suit are familiar to anyone who has purchased a suit from a men's store. The customer chooses a suit off the rack and then seeks assistance in determining whether the suit can be altered to fit his physique. Typically, to make this determination a number of measurements must be taken of the customer.

Sometimes the customer is fortunate enough to have the tailor take the measurements. The tailor will know if special considerations are required for the shape of the customer or the style of the suit. If this is the case, certain additional measurements may be necessary over and above the half dozen or so measurements normally taken. If, as an example, the customer has an athletic build with well developed thigh and bicep muscles, yet normal waist and shoulder measurements, additional measurements may be required to enable the tailor to produce a well fitting suit. It is also possible for the well-trained tailor to spot specifics in posture which may require additional measurements to be taken to more precisely match the suit to the customer.

In many retail stores, however, a tailor does not take the suit measurements. The measurements are taken by a store clerk who may not know which measurements are needed for a particular individual. The tailor operates at a distinct disadvantage when alterations are made since he will undoubtedly tailor the suit to the universal build and posture rather than what may be a very uniquely proportioned person. In these instances, the clerk's measurements may result in only an average fit.

An additional disadvantage is that the store clerk may not be able to determine when a particular customer simply cannot wear a given style suit. The trained tailor could advise against a particular choice, but the clerk may not recognize the difficulty and write up the order. The tailor may or may not recognize the difficulty in this style selection. If the tailor recognizes that these measurements and this style are not compatible, the customer will receive no suit and will have to begin the process of suit selection again. If the tailor does not recognize these limitations, the suit will be tailored but will end up looking and fitting poorly.

Those stores using a tailor to take measurements typically do a better job in fitting a suit for the customer but at the added cost of having a valuable craftsman spending time taking measurements.

DISCLOSURE OF THE INVENTION

The present invention concerns apparatus and method for taking measurements and is particularly adapted for taking measurements to aid in tailoring an article of clothing such as a suit or the like. The invention enables a store clerk with a minimal amount of training to take a number of additional measurements over and above those presently taken in a typical retail environment. The taking of these additional measurements adds a degree of precision unavailable in the prior art.

Two alternate embodiments of the invention are disclosed. A first electronic measuring tape takes a length measurement using a measuring tape connected to a multi-turn potentiometer. As the user unwinds the tape the potentiometer turns and generates an analog output proportional to the length of tape unwound. A user actuated button on the side of the tape causes the potentiometer output to be converted into a communications signal for transmission to a receiver.

A second embodiment of the invention includes both a mechanism for taking a length measurement and also a mechanism for computing an angle of the device with respect to a reference orientation. The measuring mechanism is a set of calipers with one leg of the calipers coupled to a slide potentiometer that generates an analog output proportional to a length separation between the legs of the caliper. A plumb bob pointer mounted to the device is coupled to a rotatable potentiometer so that as the pointer rotates the potentiometer yields an indication of the tilt of the device with respect to the vertical.

The means for storing the measurements preferably includes a video display for prompting the user as to a sequence in which the measurements are to be taken. A measurement request is displayed on the screen, so that the person taking the measurements can position the measuring device in relation to a subject to take this measurement. When the user is satisfied that the hand held unit is properly positioned, he actuates a button which causes the length and in the second embodiment the angle measurement to be transmitted to the storage unit.

A preferred send and receive mechanism for use in conjunction with a hand held unit is an FM transmitter/receiver where the transmitter is mounted to the hand held unit and the receiver located a short distance away from the transmitter and electrically coupled to the storing unit. Actuation of a push button on the side of the hand held unit causes data transmission between transmitter and receiver and causes the video display to prompt the user to take the next measurement. Circuitry for accomplishing these steps will be described in conjunction with the detailed description of a preferred embodiment of the invention.

Practice of the invention facilitates the job of the person taking the measurements. The prompting feature makes it easier to train the user since he only needs to know which measurements correspond to which prompts. As the measurements are taken, the user need not write them down since they are automatically stored once the push button actuater is activated. This step avoids possible transcription errors on the part of the user. If a transmitter should fail, either embodiment can still be used in a manual mode by transcribing the results.

One feature of the invention is a capability to perform a rough or initial check of the measurements to determine whether a gross error in measuring has occurred. Thus, once all the measurements are taken, it is possible for the user to ask the storage unit to display a profile of the customer he has been measuring. If this profile is in rough agreement with the actual profile of the customer, it is assumed that the measurements have been properly taken and can be used to make alterations in the garment.

A preferred storing unit comprises a personal computer having an interface with the FM receiver as well as a storage device such as a floppy disk or hard disk drive. In addition to these storage devices, one embodiment of the invention includes a printer for generating a hard copy of the measurements taken.

From the above, it should be appreciated that one object of the invention is provision of a hand held measuring device particularly suited for taking a customers' measurements when tailoring an article of clothing. This and other objects, advantages, and features of the invention will become better understood when a detailed description of a preferred embodiment of the invention is described in conjunction with the accompanying drawings.

BEST MODE FOR CARRYING OUT THE INVENTION

Figure 1:
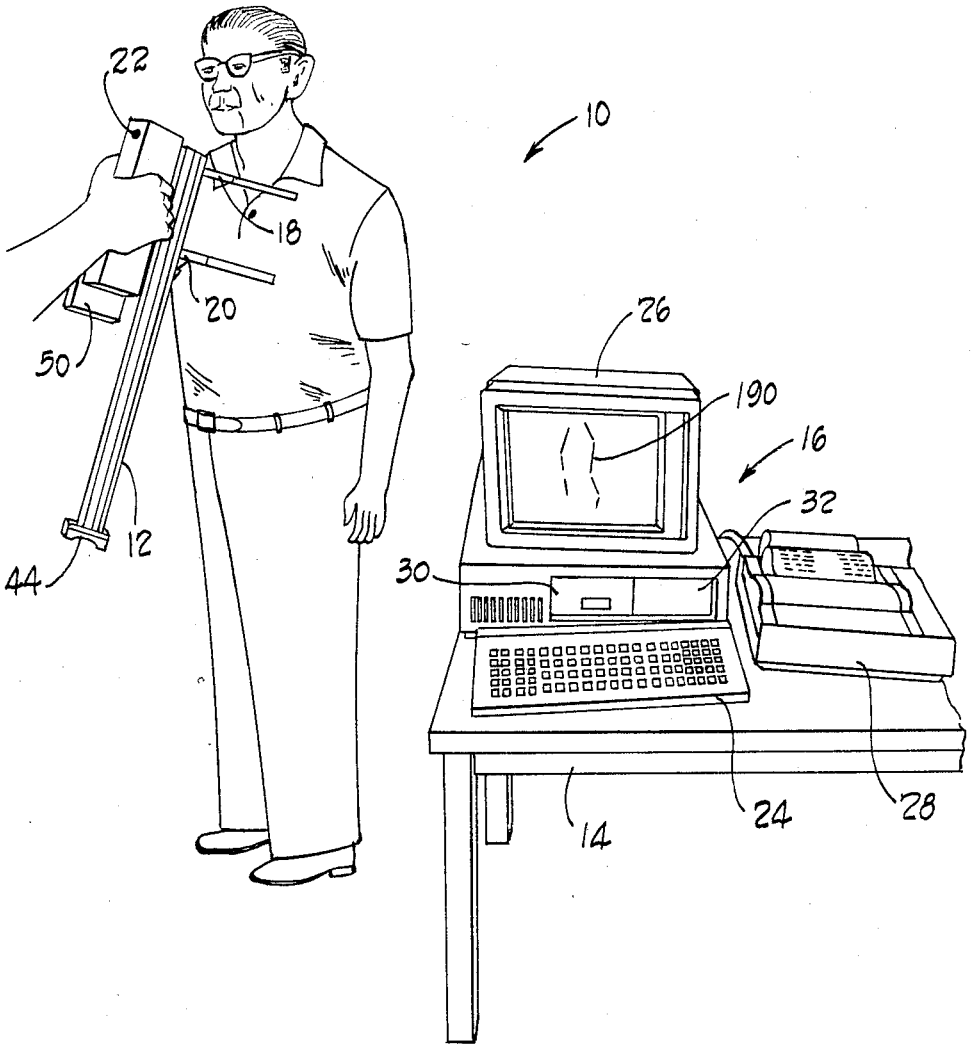
FIG. 1 is a schematic of a measuring station showing a hand held measuring device being used in taking measurements of a subject.
Figure 2:
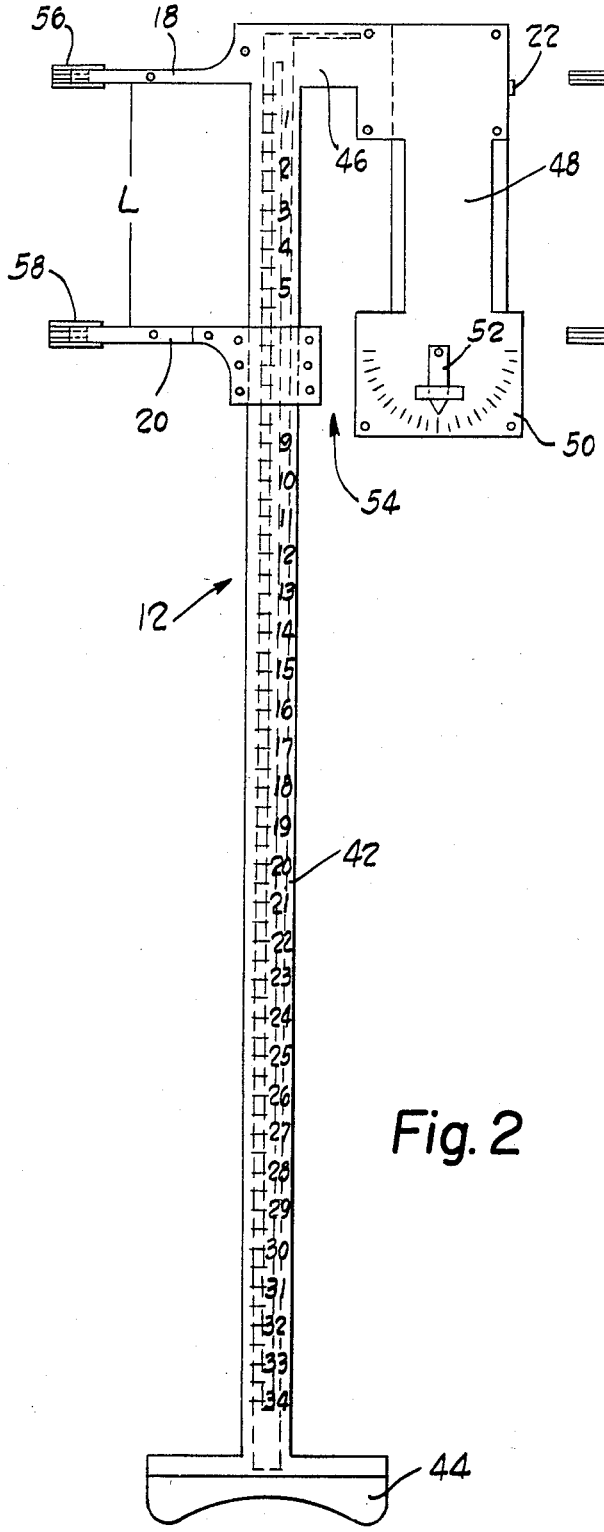
FIG. 2 is a side elevation view of one embodiment of an electronic measuring device constructed in accordance with the invention.
Figure 3:
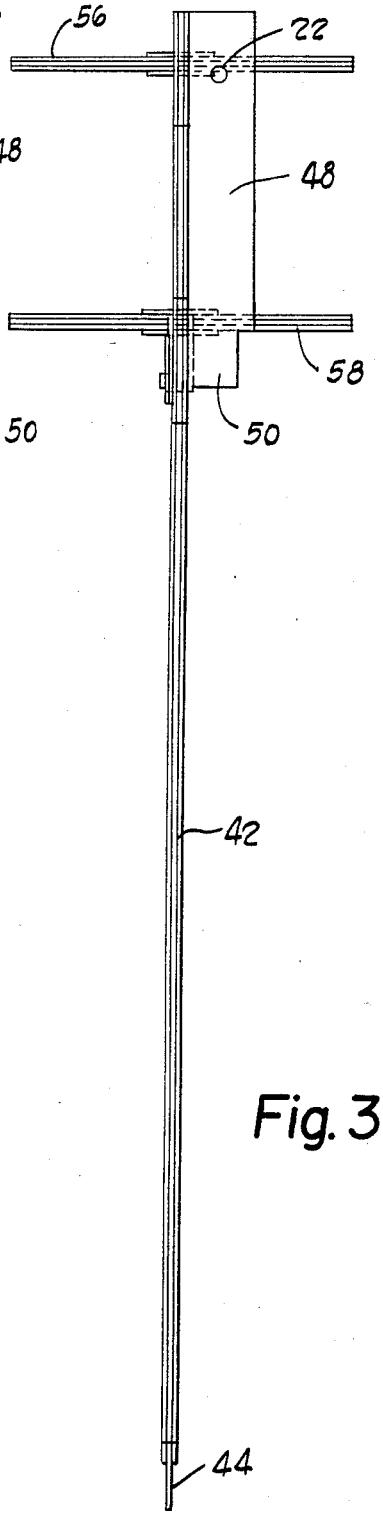
FIG. 3 is an end elevation view of the FIG. 2 device.

Turning now to the drawings and in particular to FIG. 1, there is illustrated a measuring location or station 10 showing one embodiment of a hand held measuring device 12 in use. Supported on a table 14 is positioned a storage unit 16 for storing measurements taken by the measuring device 12.

In accordance with a preferred embodiment of the invention, the hand held measuring device 12 is particularly adapted to aid one in taking measurements for use in tailoring an article of clothing or the like. The particular device 12 shown in FIG. 1 has a mechanism for taking both a length and an angle measurement.

In operation, a user positions the measuring device 12 so that two caliper arms 18, 20 are positioned to measure a desired length separation on a subject and then actuates a pushbutton switch 22 on the unit. In response to this actuation, circuitry mounted inside the device 12 generates an electrical output corresponding to this length and also determines an angle the device 12 makes with the vertical and generates an electrical output corresponding to this angle. These outputs are converted into signals suitable for transmission to the storage unit 16 and sequentially transmitted to that unit.

The storage unit 16 may comprise any unit suitable for storing signals, but in a preferred embodiment of the invention, the unit 16 comprises a personal computer having a keyboard input 24, a visual display monitor 26 and a printer 28. The storage unit 16 also includes a central processing unit mounted to a motherboard as well as interface boards for coupling various inputs to the motherboard. One interface board provides a coupling between the central processing unit on the motherboard and a floppy disk drive 30 which comprises one suitable mechanism for storing data from the hand held measuring device 12. In accordance with a preferred embodiment of the invention the storage unit 16 comprises an IBM (Registered Trademark) personal computer with a hard disk drive 32 that allows rapid data storage as well as a more permanent means of storing that data.

In accordance with one feature of the invention, the computer prompts the user as to the proper procedures to take in performing the various measurements the device 12 is capable of taking. Thus, the operating system of the computer sequentially prompts via the display 26 the user as to which measurement is to be taken. The user than reorients the measuring device 12 to take the particular measurement and actuates the pushbutton 22 so that a length and angle measurement are automatically transmitted to the computer 16.

Figure 8:
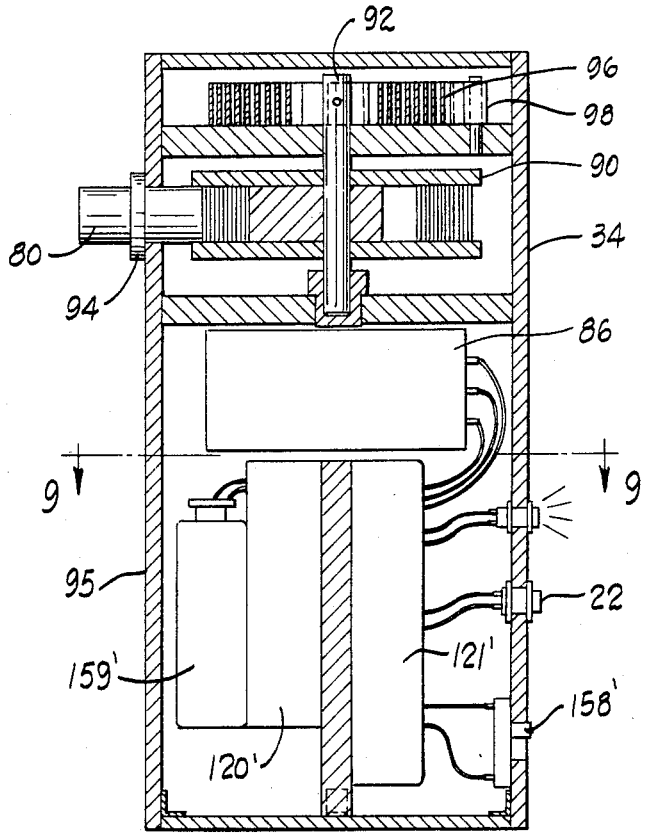
FIG. 8 is a partially sectioned view of an alternate embodiment of a hand held measuring device constructed in accordance with the invention.
Figure 9:
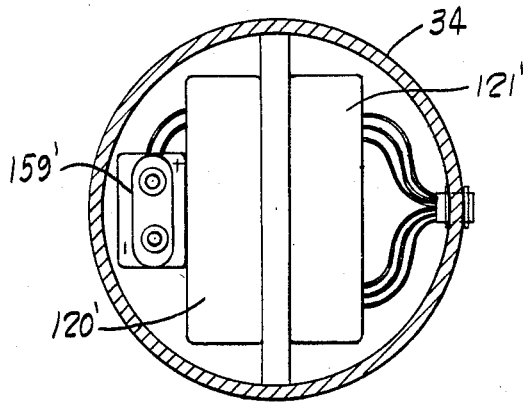
FIG. 9 is a view taken along the line 9—9 in FIG. 8.

An alternate hand held unit 34 is illustrated in FIGS. 8 and 9. This unit 34 is strictly a measuring device for performing length measurements along a straight, curved, or zig-zagging direction. The user must therefore distinguish when a prompt appears on a screen 26 as to which of the two units 12 or 34 is to be used in taking a measurement. Each unit includes its own transmitter portion (to be described), whereas the storage unit 16 includes a single receiver responsive to transmissions from either of the two hand held units 12, 34.

Further details of the embodiment shown in FIG. 1 are available by reference to FIGS. 2–7. These Figures show how two caliper arms 18,20 take a length measurement. A first of the two caliper arms 18 is fixed in relation to the measuring device 12 and extends at approximately right angles away from a ruler 42 which extends the length of the measuring device 12. A second of the caliper arms 20 is slidably mounted to the ruler 42 and its position can be adjusted so that the two arms 18,20 are separated by a particular length L of interest. Thus, in the FIG. 1 illustration of the measuring device 12, the two arms 18,20 have been manually positioned so that the separation between the neck and chest is measured. To take the measurement, the user positions the device 12, adjusts the arm separation, and actuates the pushbutton 22. A manual measurement may also be taken by noting the separation distance between the arms.

At an end of the ruler 42 opposite the position of fixed caliper arm 18, is a contoured end piece 44 similar in shape to the arm support on a crutch. When an insleeve measurement is to be taken, the end piece 44 is positioned under the subject's arm and the movable or adjustable caliper arm 20 is moved along the ruler 42 until it is positioned next to the subject's hand where a coat sleeve would end. The user then actuates the button 22 and this measurement is automatically transmitted to the storage unit 16.

At the same end of the ruler 42 as the fixed arm 18 is a neck piece 46 that couples the ruler 42 to a handle 48 which the user grasps while positioning the measuring device 12. At the bottom of the handle 48 is located a protractor 50 including visible angle markings and a pivotally mounted pointer 52 for obtaining an angle measurement. As the measuring device 12 is oriented in relation to the subject, the pointer 52 is free to pivot thereby providing an indication of the device's orientation with respect to the vertical. These angles can be helpful in determining the posture of the subject. In FIG. 1 when determining the length between the neck and chest position the pointer 52 pivots away from its position shown in FIG. 2 to yield an indication of the angle between the vertical and the orientation of the device 12. In accordance with the invention, this angle measurement is also transmitted when the user actuates the pushbutton 22. The riser can also take a manual reading in the event the transmitter malfunctions by observing the pointer position with respect to the angle markings on the protractor. As seen most clearly in FIG. 2, the protractor 50 and ruler 42 are separated by a gap 54 to allow the slidable caliper arm 20 to move continuously from a position next to the stationary arm 18 to the extreme opposite end of the ruler 42 next to the end piece 44.

Each of the caliper arms 18, 20 serves as a mount for one of two cross pieces 56, 58. During each of the measurements taken with the device 12 the cross pieces can either be positioned to aid in the length measurement or can be removed so that only the arms 18, 20 extend away from the ruler 42. In the FIG. 1 measurement, the two cross pieces are shown in place but, for example, if the sleeve length were being measured, the cross pieces would be removed and only the caliper arms 18, 20 would be relied upon in positioning the device 12.

Figure 5:
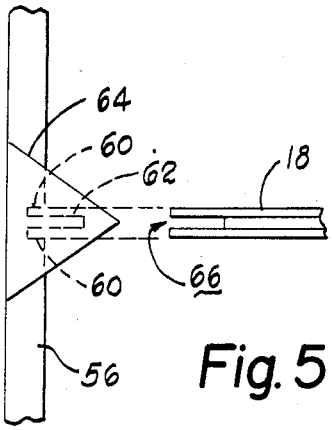
FIG. 5 is an enlarged plan view of the hand held measuring device showing a detachable cross piece coupled to a caliper arm of the device.
Figure 4:
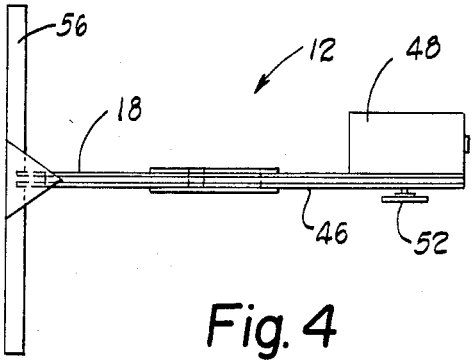
FIG. 4 is a plan view of the FIG. 2 device.

Details of the manner in which the cross pieces are mounted to the arms are illustrated in FIGS. 4 and 5. Each cross piece 56,58 defines an elongated member having two notches 60 separated by a finger 62. The notches and finger are bound on either side by triangular shaped guide pieces 64 which are flush along the base of the the cross piece and which extend outwardly away from the cross piece to bound the finger 62 on either side.

Each of the caliper arms 18, 20 defines a notch 66 into which the finger 62 on the cross piece fits when the cross piece is placed in position for measurement. Thus, the notch 66 and finger 62 in combination position the cross piece along one degree of linear movement and the two triangular guides 64 define the position of the cross piece in a perpendicular or orthogonal direction. The mating between cross piece and caliper arm is maintained by an interference fit between the two.

Figure 6:
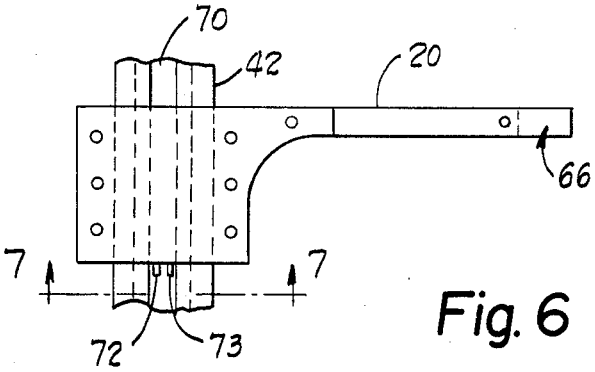
FIG. 6 is an enlarged elevation view of a movable arm forming one of two caliper arms on the FIG. 2 measuring device.
Figure 7:
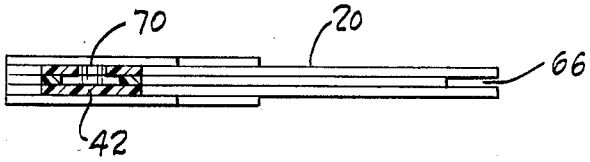
FIG. 7 is a sectional view taken along the line 7—7 in FIG. 6.

FIGS. 6 and 7 show details of the coaction between the movable caliper arm 20 and the ruler 42. The caliper arm 20 defines a through passage for the ruler 42 and includes a ridge or tongue 70 which mates with a groove defined by the ruler 42. Coupled to the caliper arm 20 are a pair of electrical contacts 72, 73 which ride against the ridge 70 extending along the length of the ruler 42. These electrical contacts 72 provide an indication of the position of a movable caliper arm 20 in relation to the ruler 42.

The ridge 70 comprises two metallic elements separated by an insulator. One metallic element has a very low resistance and provides a ground for one of the contacts 72. A second metallic element has a uniform resistance per unit length and serves as a strip potentiometer. The second contact 73 rides on this strip and provides an indication of the resistance between the caliper arm 20 and the end of the ruler 42 near the neck portion 46. In this way the resistance separation between the two arms 18 and 20 is known and this resistance is converted into a voltage output via a simple voltage divider circuit where one leg of the voltage divider is the metallic strip.

When measurements are taken between the end piece 44 and the movable arm 20, the resistance is again used in calculating the distance between the two arms 18, 20 and this distance is subtracted (by the computer) from the distance between the stationary arm 18 and the end piece 44.

The second embodiment 34 (FIG. 8) of the measuring device includes a flexible measuring medium or tape 80 having a plurality of equally spaced markings extending along the medium to give a visual indication of length. The medium 80 is also coupled to a potentiometer 86 mounted inside the measuring device 34 which rotates with linear movement of the measuring tape 80. The particular potentiometer chosen is a twenty turn potentiometer which generates an analog output proportional to the length of movement of the tape 80.

The tape 80 is mounted to a tape take up reel 90 mounted to a potentiometer input shaft 92. The reel is biased to a position where a tape stop 94 contacts an outer surface 95 of the measuring device 34 by a coiled spring 96. The spring 96 is coupled at one end to the potentiometer input shaft 92 and at an opposed end to a stationary anchor pin 98. As the tape 80 is withdrawn the spring is coiled thereby exerting a restoring force on the take up reel 90.

Figure 10:
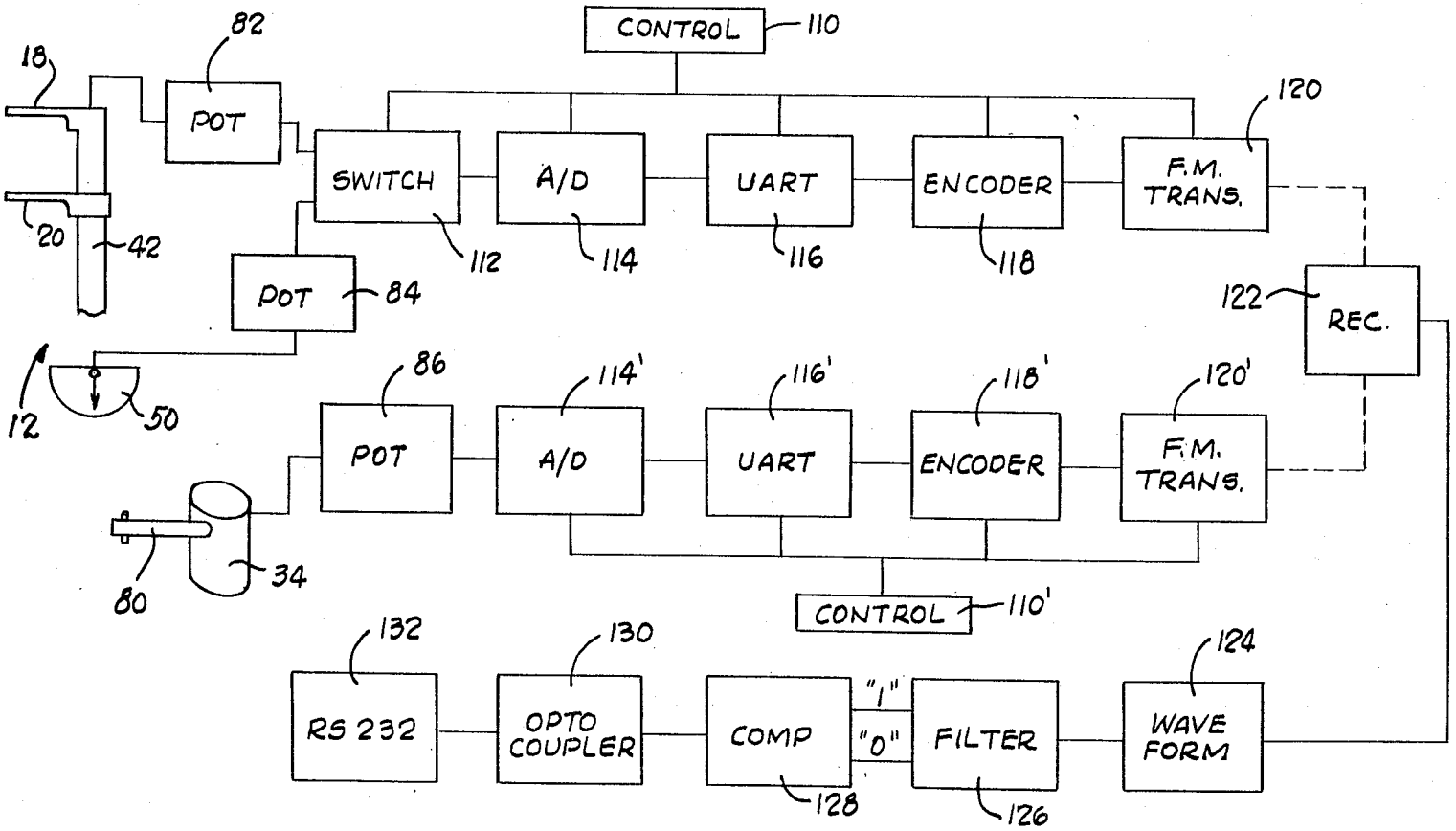
FIG. 10 is a schematic block diagram of circuitry used with the measuring devices of FIGS. 2 and 8.

Turning now to the FIG. 10 schematic, the circuitry for converting outputs from the hand held measuring devices 12, 34 into communications signals is illustrated. As noted previously, each of the measuring devices, i.e., the caliper arms 18, 20, the protractor 50, and the measuring medium 80 is coupled to its own potentiometer. These potentiometers have been designated with reference characters 82, 84, and 86 in FIG. 10.

To illustrate the transmittal of this information to the storage unit 16, consider the example in which the hand held measuring device 12 is positioned next to the subject and the user wishes to store the relevant length and angle measurements indicated by the measuring device. The button 22 is actuated and a control unit 110 sequentially switches the analog output from the two potentiometers 82, 84 through an analog switch 112 to an analog-to-digital converter 114. In a preferred embodiment of the invention the control unit 110 directs the analog output from the second potentiometer 84 (coupled to the protractor) to the analog to digital converter 114 before the length measurement from the caliper arms.

At the analog-to-digital converter 114, the analog outputs from the potentiometers 82, 84 are converted into a 10 bit digital signal which is then transmitted to a universal asynchronous receiver/transmitter (UART) 116. The UART converts the data from parallel to serial format and transmits this data to an encoder 118 which generates a sequence of frequency modulated signals where the frequency of the signals indicates either a "one" or "zero" state. Thus, the encoder 118 converts the 10 bit signal sequence of ones and zeros from the UART into a frequency modulated sequence of signals. The encoder output is transmitted to a frequency modulated (FM) transmitter 120. The preferred transmitter is a commercially available FM transmitter from the Maxon Electronic Co. Ltd., 10727 Ambassador Dr., Kansas City, MO 64153. Other suitable transmitters are available and could be substituted for this transmitter. The transmitter 120 comes in a self contained package separate from a module 121 (FIG. 8) in which the A/D converter 114, UART 116, and Encoder 118 are packaged.

A Maxon receiver 122 coupled to the storage device 16 receives the frequency modulated output from the transmitter 120 and transmits this output to a waveform generator 124. The waveform generator converts the sinusoidal signal from the transmitter into a square wave signal which is transmitted to a filter unit 126. The filter 126 divides the square wave output from the waveform generator 124 depending upon the frequency of that output. The filter separates into two distinct paths, the "on" and "off" signals from the FM transmitter 120. These signals are routed to two inputs on a comparator 128 which only transmits the "on" or high outputs. These are in turn coupled to an optocoupler 130 which via a standard light emitting diode/transistor pair, transmits signals to a RS232 input 132 on the storage device 16. In this way, the analog output from the potentiometers is converted into a digital input at a standard RS232 interface for a personal computer. Computer software in the computer operating system monitors this input and converts the serial data into a representation of the analog output and stores this data in memory.

The operation of the potentiometer 86 coupled to the second embodiment of a hand held measuring device 34 is completely analogous with the exception that no analog switch is needed since the device 34 generates only one analog output from its potentiometer 86. The A to D conversion data encoding and transmission are in every other respect identical for the two units. Since the device 34 has its own separate circuitry for performing their functions, the hardware modules for the second hand held device 34 have been designated with prime (') reference numerals in FIG. 10.

Figure 11:
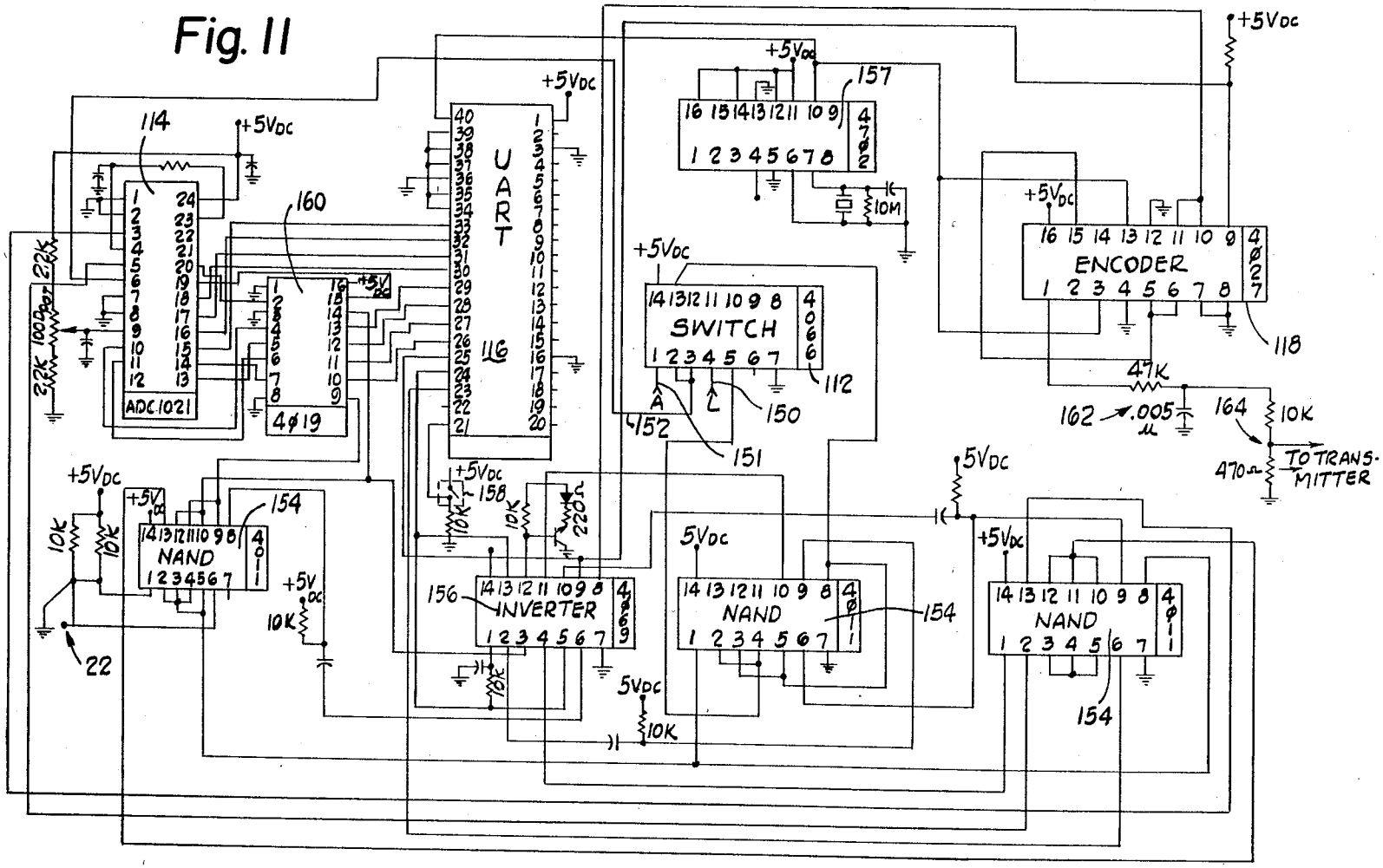
FIG. 11 is a detailed electrical schematic of a transmitter interface portion of the FIG. 2 device.
Figure 12:
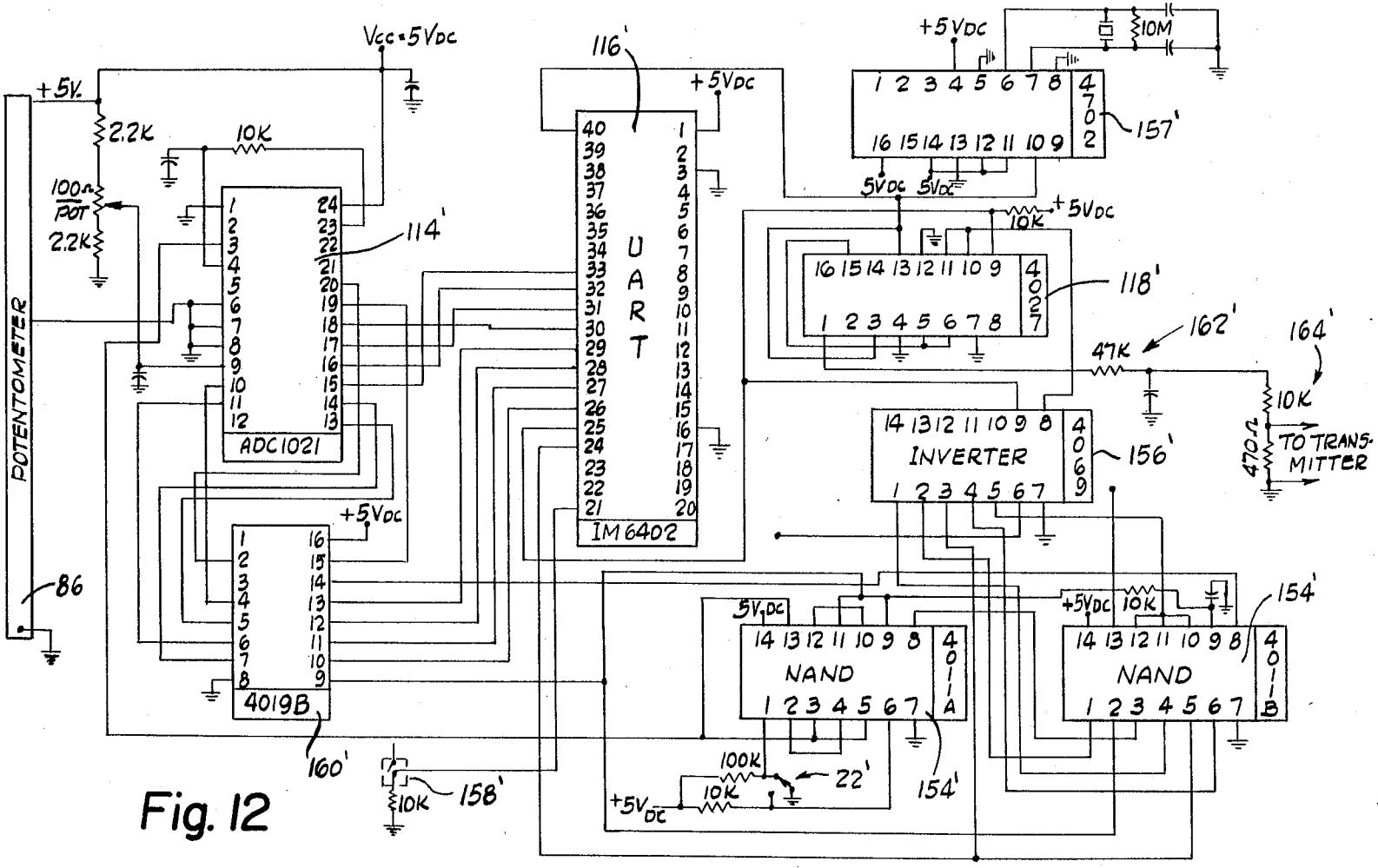
FIG. 12 is a detailed electrical schematic of a transmitter interface for the FIG. 8 device.
Figure 13:
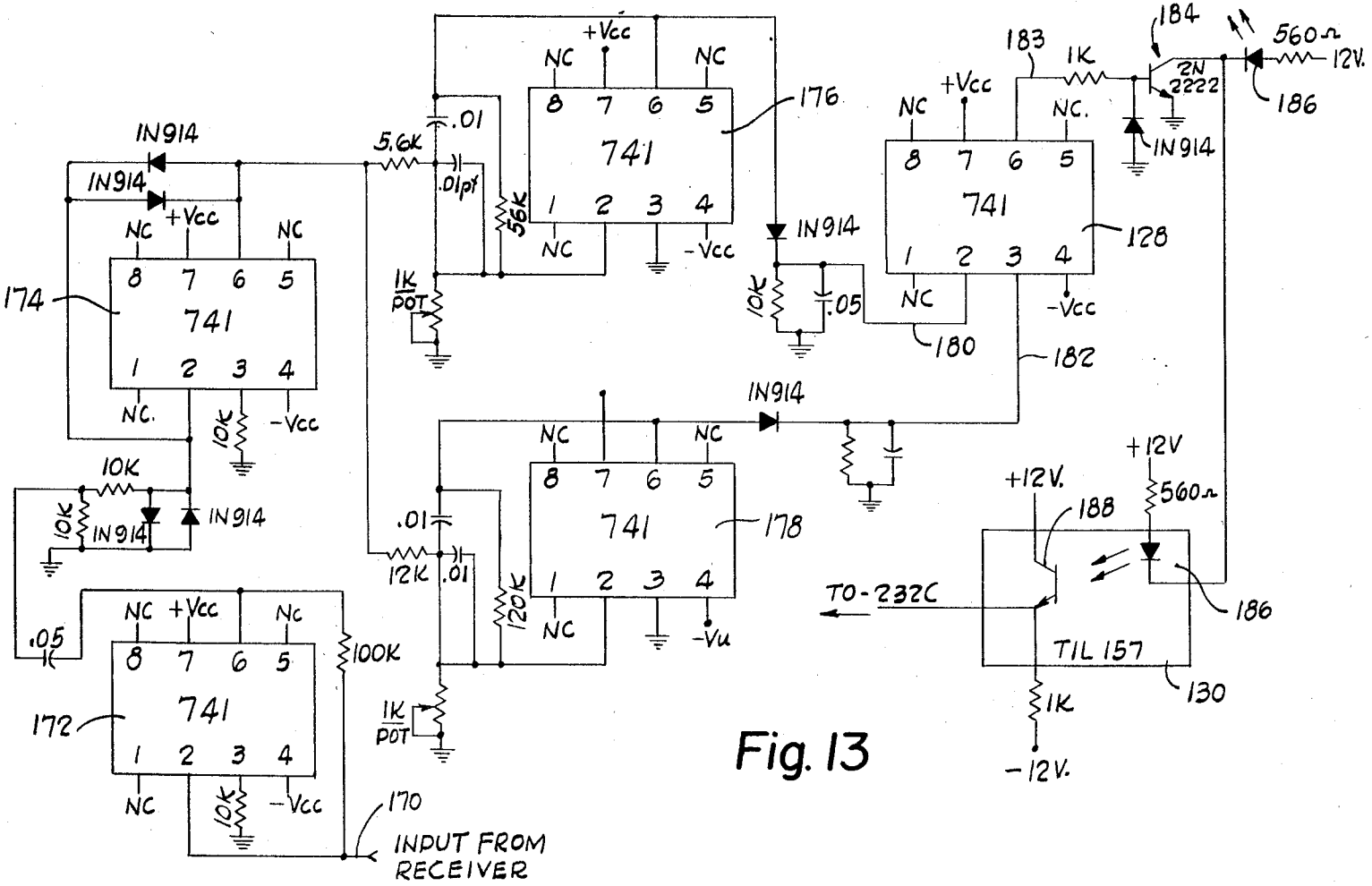
FIG. 13 is a detailed electrical schematic of a receiver interface for the hand held measuring device.

FIGS. 11–13 illustrate details of the circuitry schematically disclosed in FIG. 10. The transmitter circuitry for the hand held unit 12 is disclosed in FIG. 11. As seen in that figure, two inputs 150, 151 to the analog switch 112 are selectively coupled via an output 152 to the analog to digital converter 114. The part designation (4066) on the analog switch is for CMOS circuitry and is commercially available from a number of sources. The integrated circuits chosen for the preferred embodiment disclosed in FIG. 11 are all identified with CMOS part numbers and were purchased from National Semi-Conductor.

Timing and control signals for the switch 112 are generated by the control circuit 110, which comprises three nand circuits 154, a single inverter circuit 156 and a band rate generator or clock 157. The circuitry illustrated requires a 5 volt DC energization signal, which is provided via a conventional 9 volt battery 159 (FIG. 8) coupled to a voltage regulator (not shown) for producing a 5 volt signal. As seen in the FIG. 11 representation, the nand gates 154 and inverter 156 each have a 5 volt input coupled to the output of this voltage regulator.

A power "on" switch 158, mounted to each of the hand held measuring devices 12, 34 provides this coupling and in addition provides a reset input to the UART 116. The switch 158 is a 3 position sliding switch, which the user slides to a reset position and then lets go so that the switch temporarily provides a reset to the UART and then slides back into its middle position in which the 5 volts from the voltage regulator is coupled to the various circuits shown on the diagram.

The push button switch 22 is coupled to the control circuit 110 so that each time this switch 22 is closed, the circuit 110 obtains the readings from the two inputs 150, 151 and transmits them to the digital to analog converter 114. This is accomplished via controlling the status of pin 5 on the analog switch 112.

The disclosed UART 116 can receive 8 bits of data at a time. The desired resolution of the present system, however, is 10 bits. To provide this degree of resolution, the system includes a multiplexer 160 to control switching of data to the UART. Under control of the control unit 110, the analog-to-digital converter 114 first passes 8 bits of the required 10 data bits data to the UART 116. Four of these bits are directly coupled from output pins on the analog to digital converter 114 to the UART 116, and four additional bits are coupled from the analog to digital converter through the digital multiplexer 160.

In a next time frame, the control unit 110 switches the digital multiplexer 160 so that two remaining bits from the analog to digital converter can be passed to the UART 116. The remaining six bits, which are passed in this second time frame, are redundant data and are stripped from the data stored by the storage unit 16. This is accomplished in software in the storage unit, rather than by the hardware of FIG. 10.

The UART 116 generates an output at pin 25, which is a serial message corresponding to the parallel data input from the multiplexer 160 and the analog-to-digital converter 114. The output from the UART is coupled to pin 9 of the encoder 118, which converts the sequence of "on/off" pulses from the UART into a sequence of frequency modulated pulse. A zero or "off" logic state corresponds to a frequency of 1,200 hertz, and a one or "on" condition corresponds to a frequency of 2,400 hertz. The output from pin 1 of the encoder 118 is a series of these frequency modulated signals. This output is generally square-shaped, and is rounded by a filter 162, and attenuated by a voltage divider 164. The output from the voltage divider is coupled directly to input terminals of the Maxom transmitter 120.

Turning now to FIG. 13, a receiver portion of the FIG. 9 schematic is illustrated. The circuitry shown in FIG. 13 includes an input 170 coupled to an output from the receiver 122. This input carries either 1,200 or 2,400 hertz signals from the receiver and passes those signals to an amplifier 172 and voltage limiter 174. In combination, the amplifier and limiter produce a square wave output from the approximately sinusoidal transmission from the receiver. This square wave output is coupled to two filter units 176, 178. The first filter 176 transmits 2,400 hertz signals and attenuates the 1,200 hertz signal. The second unit 178 transmits the 1,200 hertz signal while attenuating the 2,400 hertz signal. Outputs from these two filter units 176, 178 are coupled to two inputs 180, 182 on the comparator 128. The comparator 128 passes the high frequency signal, but not the lower of the two frequencies. Stated another way, when the input 178 is high and the input 182 is low, an output 183 from the comparator is high, and when the opposite condition exists, the output 183 from the comparator 128 is low.

A high output from the comparator 128 turns on a transistor 184, which in turn causes current to flow through a light emitting diode 186. This light emitting diode 186 gives a visual indication as to when a transmission is occurring between the hand held unit 12 and the Maxon receiver.

When the transistor 182 conducts, a signal is coupled to the opto-coupler 130, which includes a second light emitting diode 186 and a phototransistor 188, which turns on in response to an output from the light emitting diode 186. When this transistor 188 conducts, an output to an RS232 connection goes to plus 12 volts and when a transistor 188 is not conducting, this output is at minus 12 volts. Thus, a series of either plus or minus 12 volt signals (corresponding to the zero and one state in digital format) is transmitted to an interface to the storage unit 16. Software in this unit stores the signals by converting them into data representations suitable for storing. Since the resolution provided by the measuring device 12 is 10 bits, the storage unit 16 utilizes two 8 bit bytes to store the information.

A comparison of the FIG. 11 and FIG. 12 schematics show a strong degree of similarity. The FIG. 12 schematic is coupled to an output from the FIG. 8 measuring device 34, and since this device generates only one analog signal related to a measurement taken by the device, a single output from the potentiameter 86 is directly coupled to the analog to digital converter 114'. This arrangement obviates the need for the analog switch 112 in FIG. 11 and reduces from five to four the number of integrated circuits needed to generate control signals in the control unit 110'. In every other aspect, the two circuits are identical and therefore the FIG. 12 schematic needs no further elaboration.

Once all the measurements have been taken, the storage unit 16 utilizes the information entered from the two units 12, 34 to provide a rough profile 190 of the subject of interest. This profile 190 (FIG. 1) is displayed upon the visual display 26 and allows the user to quickly compare the display with the subject to determine if a gross error has been made in entering the data. If there is an approximate match, the measurement taking process for the subject has been completed. If desired, the measurements can also be output on the printer 28 as well as stored on floppy disk or hard disk.

The invention has been described with a degree of particularity. Certain design modifications or alterations are possible, and it is the intent that all such modifications and/or alterations in the invention falling within the spirit or scope of the appended claims be protected.

We claim:

1. A measuring system comprising:

a hand held unit for measuring a length; said hand held unit including a ruler for measuring the length, means for generating an electric signal related to the length, interface means to convert the electrical signal into a digital signal representation of the length, and transmitter means for converting said digital signal representation into a communication signal suitable for radio communications transmission; and receiver means remote from the hand held unit including means for receiving said radio communication signal and converting said signal into an electric signal; and a storage unit for storing an indication of said length.

2. The apparatus of claim 1 wherein said storage unit includes a video display for prompting a user regarding which length measurements to take in what sequence

3. The apparatus of claim 2 wherein the said hand held unit is used to take measurements on a person for tailoring an article of clothing and the storage unit includes means for displaying a profile of the person once said measurement have been taken to provide a visual check of the accuracy of the measurements.

4. Apparatus comprising:

a measuring device for taking a length measurement;

means mounted to the measuring device for converting an indication of said length into a communications signal;

remotely positioned receiver means for receiving said communications signal and converting said communications signal into an electrical signal; and means for storing said length measurement as indicated by said electrical signal.

5. The apparatus of claim 4 wherein said means for storing includes a video display for prompting a user regarding which length measurements to take in what sequence.

6. An electronic measuring tape comprising a length of measuring material, a spring biased tape take-up reel around which the measuring material winds and unwinds, a potentiometer coupled to said reel for generating an electrical output corresponding to a length said material has been unwound from the reel, and transmitter means for converting the electrical output from the potentiometer into a communications signal encoded with the length measurement for transmission to a remotely positioned storage device.

7. A hand held measuring device comprising:

a set of calipers having one arm fixed with respect to and a second arm movable with respect to an elongated ruler to which the arms are secured;

a strip potentiometer coupled to and extending along one surface of the ruler to produce a first signal related to a distance between the first and second arms;

protractor means for computing an angle of said elongated ruler with respect to a reference angle as the calipers are positioned to measure said length, said protractor means including a potentiometer that provides a second signal related to said angle; and circuitry for converting said first and second signals into digital signals suitable for transmission to a remote unit for storing an indication of said length and angle.

8. A method for taking measurements in tailoring an article of clothing comprising the steps of:

aligning a measuring device next to a subject, said measuring device including means which takes a length measurement, converting the length measurement to a digital signal corresponding to the length measurement;

generating and transmitting a radio signal corresponding to said digital signal to a receiver; and storing said length measurement in a storage means for later access during tailor of an article of clothing.

9. The method of claim 8 wherein said storage means includes a video display and a programmable controller and the method comprises the additional step of prompting a person taking the measurements as to a sequence in which to take those measurements.

10. The method of claim 8 additionally comprising a step of measuring an orientation of said measuring device with respect to a reference orientation and transmitting said orientation to the storage means.

11. Apparatus for taxing measurements in tailoring an item of clothing comprising:

a hand held unit including a set of calipers for taking a length measurement and means for measuring an orientation of said unit as said unit is positioned next to a subject to obtain said length measurement;

a communications transmitter mounted to said unit for receiving signals corresponding to said length measurement and said orientation and converting said signals into a communications signal, said transmitter operative to send a communications signal in response to a hand actuated control mounted to said unit;

receiver means for receiving said communications signal and converting said signal back to an electrical signal; and a controller unit for storing indications of said length and orientation, said controller unit including an interface with said receiver to transmit indications of said length and orientation to storage means in said controller.

12. The apparatus of claim 11 wherein the controller unit includes means for prompting a user concerning which measurements to take in what sequence.

13. The apparatus of claim 11 where said means for prompting includes a video display screen.

14. A hand held measuring device comprising:

a ruler and a set of first and second caliper arms with one of said arms fixed with respect to said ruler and a second of said arms slidably mounted to said ruler for movement along a length of said ruler;

means for sensing a separation between said arms including an elongated metal strip mounted to said ruler and contacts mounted to said second arm, said strip and contacts forming a first potentiometer for measuring the resistance of a portion of said strip between said caliper arms;

means for sensing an orientation of said device as the separation is sensed, said means for sensing including a pointer pivotally mounted to said device and a second potentiometer having an input shaft coupled to the pointer to sense rotation of said pointer with device orientation; and means coupled to said first and second potentiometer to generate electrical signals corresponding to said separation and said orientation.

15. The measuring device of claim 14 additionally comprising means for digitizing said first and second signals, encoding said digitized signals into a frequency modulated sequence of pulses and transmitting said frequency modulated sequence to a receiver for storage of said angle and length measurement.

16. Apparatus for taking measurements comprising:

a hand held unit including a pair of caliper arms connected to a slide potentiometer for obtaining a length mesurement between the two arms and protractor means coupled to a rotatable potentiometer for measuring an orientation of said unit as said unit is positioned next to a subject to obtain said length measurement;

means coupled to said slide and rotatable potentiometers for converting an analog output from said potentiometers into digital signals;

means for converting said digital signals into frequency modulated signals where one frequency signal corresponds to one digital state and a second frequency signal corresponds to a second state;

a communications transmitter mounted to said unit for receiving said frequency modulated signals corresponding to said length measurement and said orientation and converting said signals into a communications signal;

receiver means for receiving said communications signal and converting said signal back to a frequency modulated electrical signal;

means for converting said frequency modulated signal back into a digital signal; and means for coupling said digital signal to a storage unit wherein said length and orientation measurements are stored.

* * * * *